US005760741A

United States Patent [19]

Huynh et al.

[11] Patent Number: 5,760,741

[45] Date of Patent: Jun. 2, 1998

[54] BEAM FORMING NETWORK FOR MULTIPLE-BEAM-FEED SHARING ANTENNA SYSTEM

[75] Inventors: Son Huy Huynh, Gardena; Chun-Hong Harry Chen, Torrance; Kimberly Ho, Lakewood; Antony Ho, Torrance, all of Calif.

[73] Assignee: TRW Inc., Redondo Beach, Calif.

[21] Appl. No.: 629,860

[22] Filed: Apr. 9, 1996

[51] Int. Cl.[6] ..... H01Q 3/22; H01Q 3/24; H01Q 3/26

[52] U.S. Cl. ..... 342/373; 343/700 MS

[58] Field of Search ..... 342/373; 343/700 MS

[56] References Cited

U.S. PATENT DOCUMENTS

| | | | |
|---|---|---|---|
| 4,231,040 | 10/1980 | Walker . | |
| 4,424,500 | 1/1984 | Viola et al. . | |
| 4,543,579 | 9/1985 | Teshirogi | 342/365 |
| 4,901,084 | 2/1990 | Huguenin et al. | 342/179 |
| 4,907,004 | 3/1990 | Zacharatos et al. | 342/373 |
| 5,151,706 | 9/1992 | Roederer et al. | 342/372 |
| 5,539,415 | 7/1996 | Metzen et al. | 343/700 MS |
| 5,548,295 | 8/1996 | Lo Forti et al. | 342/373 |

OTHER PUBLICATIONS

"Phased Array Antenna Handbook", by Robert Mailoux, Artech House, 1993.

"Antenna Engineering Handbook", by Richard Johnson, McGraw-Hill, Inc., 1993.

*Primary Examiner*—Theodore M. Blum

*Attorney, Agent, or Firm*—Michael S. Yatsko

[57] ABSTRACT

A multiple beam antenna system (10) for use in satellite communications. The system (10) includes a feed array (20) containing multiple feed elements (22) which operate in connection with communications beams. In a transmitter application, the feed elements (22) are driven by feed signals delivered thereto from a beam forming network (14). The beam forming network includes multiple beam ports (16) which receive as inputs composite beam signals. The beam forming network includes feed ports (18) as outputs which deliver feed signals to the feed array (20). The beam forming network (14) includes a divider circuit trace (48) and a combiner circuit trace (46) aligned along substantially parallel planes. Combiners (111–117) within the combiner circuit trace (46) are arranged in clusters (92), such that each combiner (111–117) within a cluster (92) operates in conjunction with a common feed signal. The dividers (121–127) are similarly grouped in clusters (94), such that each divider (121–127) within a cluster (94) operates in conjunction with a common composite beam signal. The combiner and divider clusters (92, 94) are arranged with respect to one another to simplify and minimize the length of interconnections (60) therebetween.

14 Claims, 10 Drawing Sheets

FIG. 14
PRIOR ART
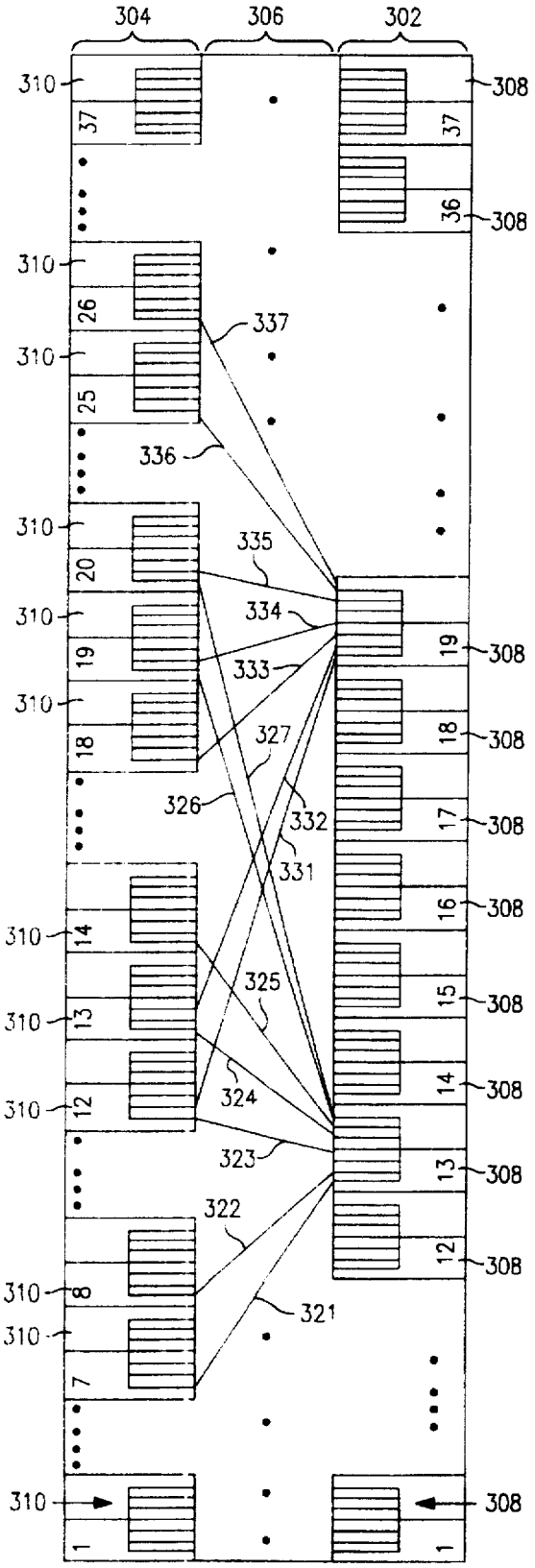
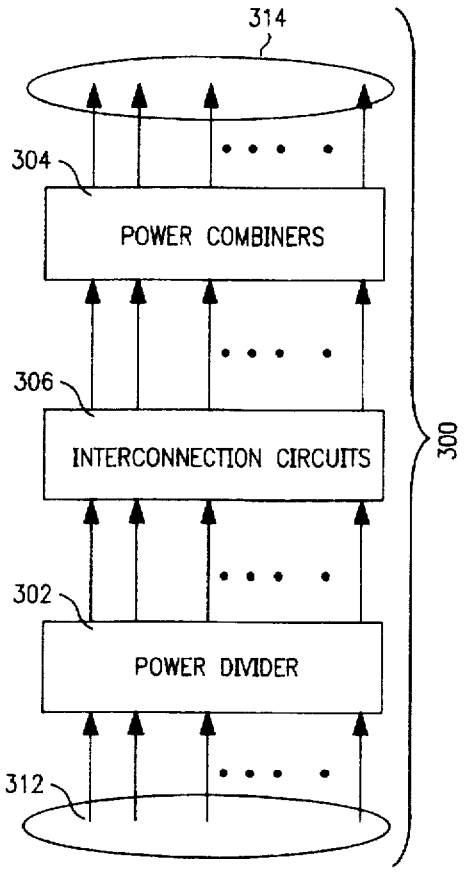
FIG. 13
PRIOR ART

BEAM FORMING NETWORK FOR MULTIPLE-BEAM-FEED SHARING ANTENNA SYSTEM

FIELD OF THE INVENTION

The present invention generally relates to communication satellites and, more specifically, to a beam forming network for use with a communications satellite.

BACKGROUND OF THE INVENTION

In general, communications satellites communicate through transmitters and receivers with remote devices. The transmitters and receivers are connected to antennas which emit and sense radio frequency (RF) signals that pass to and from the remote devices such as mobile and fixed cellular telephone stations. Hereinafter, an RF signal emitted by an antenna from either a satellite or a remote device shall be referred to as a "communications beam". The antennas include one or more feed elements (also referred to as "radiating elements") which transmit the communications beams. Similarly, when operating as a receiver, the communications beams are received by one or more feed elements. Antennas which form a plurality of communication beams are referred to as multiple beam antennas (MBA). The radiating or feed elements are generally arranged in an array geometrically shaped as a square, hexagon and the like. The MBA may use one or more feed elements in connection with each communications beam. Conventional antennas which use a single feed element in connection with each communications beam have been found to have unduly low antenna efficiency due to excessive spillover losses. To minimize spillover, past MBA systems have been proposed which utilize multiple feed elements to transmit and receive each communications beam (also referred to as a "composite beam"). These past MBA systems divide each composite or full-power beam into a set of lower power beam components. Each beam component is used to drive a separate feed element. The group of feed elements combines to generate the complete composite beam at its original power level.

In addition, past MBA systems are arranged such that feed element groups overlap whereby a feed element is driven to generate beam components from more than one composite beam. In this situation, a feed element cooperates with a number of different groups of feed elements to define a corresponding number of different beams. This phenomenon is referred to as "multiple-shared-feeds-per-beam" and is controlled by a low level beam forming network (LLBFN) within the communications satellite.

A conventional LLBFN is shown generally in FIG. 13 and in more detail in FIG. 14. With reference to FIG. 13, the LLBFN 300 includes a power divider circuit 302 and a power combiner circuit 304 connected to one another through an interconnection circuit 306. The divider circuit 302 includes a plurality of dividers 308 (FIG. 14), and the combiner circuit 304 includes a plurality of combiners 310. The dividers 308 separate or split a plurality of incoming beam signals on beam ports 312 into lower power beam components. The beam components are passed along leads in the interconnection circuit 306 to corresponding combiners 310. Each combiner 310 combines the incoming signals to form an output feed signal at feed ports 314. For purposes of illustrations, the dividers 308 and combiners 310 have been numbered in FIG. 14 from #1 to #37. If it is assumed that dividers #13 and #19 separate an incoming beam signal 312 into seven beam components, then each of dividers #13 and #19 will have seven output leads 321–327 and 331–337, respectively. The leads 321–327 from divider #13 are connected to combiners #7, #8, #12, #13, #14, #19 and #20 in order to deliver the beam component signals thereto. Similarly, divider #19 is connected to combiners #12, #13, #18, #19, #20, #25 and #26 through leads 331–337. The combiner #12 combines the beam components on lines 323 and 331 to form a feed signal.

The feed signals ultimately are fed to corresponding feed elements which emit beam components that cooperate to form the original communications beams. One example of a beam forming network is disclosed in U.S. Pat. No. 4,907,004 (Zacharatos et al.), which is incorporated herein by reference. Exemplary Multiple Beam Antenna systems can be found in *Phased Array Antenna Handbook*, by Robert Mailloux, Artech House, 1993, Chapter 8.1, and in *Antenna Engineering Handbook*, by Richard Johnson, McGraw-Hill, Inc. 1993.

However, conventional beam forming networks utilize a linear topology in which the dividers 308 and combiners 310 are arranged along two axes extending parallel to one another along opposite sides of the LLBFN. The dividers 308 distribute the power of the composite beam signal among constituent divider output leads which extend to combiners 310 distributed unevenly along the opposite side of the LLBFN. As shown in FIG. 14, each combiner 310 may receive component beam signals from dividers 308 located anywhere along the side of the LLBFN.

This conventional linear topology necessitates the use of a large number of interconnecting leads 306 of varying length between the power dividers and corresponding power combiners (as shown by leads 321–327 and 331–337). The leads 321–327 and 331–337 extend in multiple directions and form a large number of cross-overs. Hence, LLBFNs formed according to the conventional linear topology require a large physical area for implementation due to the large number of dividers 308 and combiners 310 along opposed sides and due to the large number of cross-overs and interconnecting leads 306. As the physical size of the network increases, lead transmission paths become longer which result in greater variations within the amplitude and phase of the signals passed between the dividers and combiners. Such variations are undesirable.

Further, the complexity of the interconnection circuitry within conventional LLBFNs degrades reliability. In view of the foregoing, conventional LLBFNs have proven unreliable, unduly large, heavy and expensive.

A need remains within the industry for an improved beam forming network design. It is an object of the present invention to meet this need.

SUMMARY OF THE INVENTION

It is an object of the present invention to provide a beam forming network which reduces the complexity within the circuitry.

It is a further object of the present invention to arrange power dividers and combiners within the beam forming network along two separate parallel opposed planes and to cluster the dividers and combiners based on feed signals and composite beam signals.

It is a corollary object of the present invention to provide a beam forming network having power dividers and combiners arranged in a triangular lattice to form an overall two dimensional hexagon structure.

It is a further object of the present invention to provide a beam forming network within which the dividers and combiners are grouped to limit connection to combiners and dividers located immediately adjacent thereto.

These and other objects of the present invention are provided by a multiple beam antenna system having an array of feed elements for receiving or transmitting composite communications beams. A beam forming network (FIG. 12) is included with beam ports for conveying composite beam signals representative of the composite communications beams and with feed ports for conveying, to the array, feed signals containing component beam signals. The network includes dividers 66 and combiners 80. The dividers 66 divide composite beam signals into beam component signals. The combiners 80 combine beam component signals from the dividers 66 for different composite beams to form the feed signals. The dividers 66 and combiners 80 are arranged within parallel planes 46, 48 and are clustered 92, 94 for local interconnection such that each divider 66 only connects with combiners 80 located immediately adjacent thereto in the opposed plane. Inputs and outputs of the dividers 66 and combiners 80 are further arranged such that leads extending therebetween are of substantially equal length and are aligned substantially perpendicular to the opposed planes. The system is operative with a receiver or a transmitter.

BRIEF DESCRIPTION OF THE DRAWINGS

FIG. 13 illustrates a block diagram of a prior art beam forming network; and FIG. 14 illustrates a schematic representation of the block diagram of FIG. 13.

DETAILED DESCRIPTION OF THE PREFERRED EMBODIMENT

Figure 1:
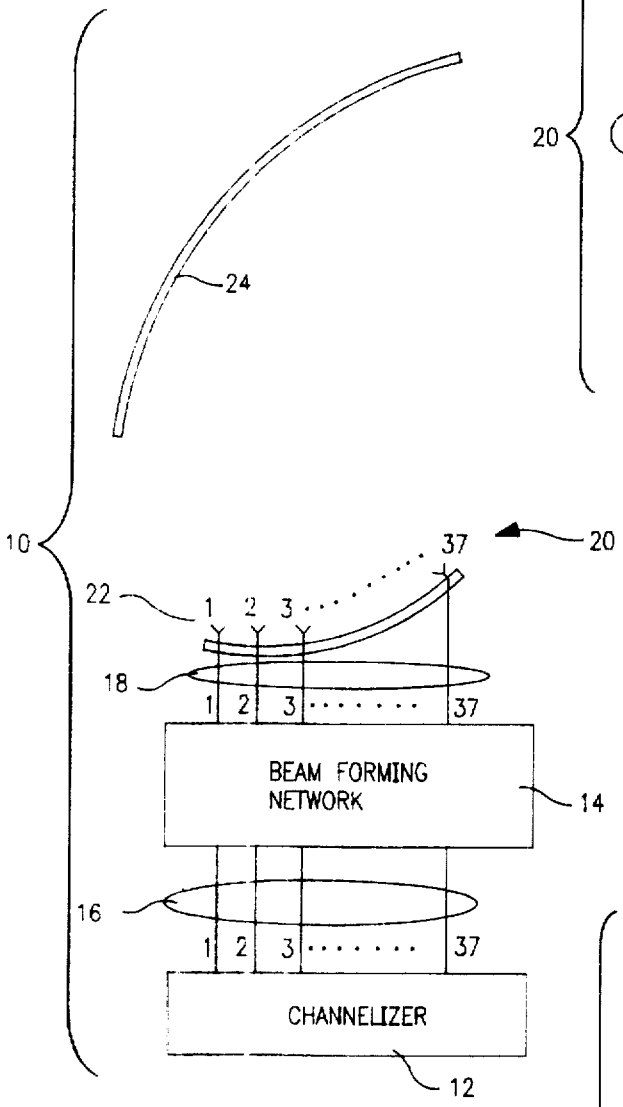
FIG. 1 illustrates a schematic view of a multiple beam antenna system according to the present invention.

FIG. 1 generally illustrates a multiple beam antenna (MBA) system, generally designated by the reference numeral 10. The MBA system 10 includes a channelizer 12 for performing a signal-channelizing operation of the system as a receiving unit and/or a transmitting unit. The channelizer routes the signals to/from the receiving/transmitting unit from/to one or more beam ports of the BFN. The channelizer 12 is interconnected with a beam forming network (BFN) 14 via a plurality of beam ports 16 which convey composite beam signals between the beam forming network 14 and the channelizer 12. The BFN 14 is connected to a feed array 20 through a plurality of feed ports 18. The feed ports 18 convey feed signals between the feed array 20 and BFN 14. The feed array 20 comprises a plurality of feed elements 22 arranged in a desired pattern and connected with corresponding feed ports 18.

In the preferred embodiment, the MBA system 10 further includes a reflector 24 which cooperates with the feed array 20 to reflect incoming and outgoing communications beams to and from the feed elements 22. Optionally, the reflector 24 may be omitted and the feed array 20 modified to operate as a direct radiating array.

Throughout the following description it is to be understood that the instant invention is equally applicable in transmitting and receiving applications. For ease of explanation, the following description is primarily in terms of a transmission application. However, the subject invention is not so limited. Instead, the inventive system is equally applicable in receiver systems.

Figure 2:
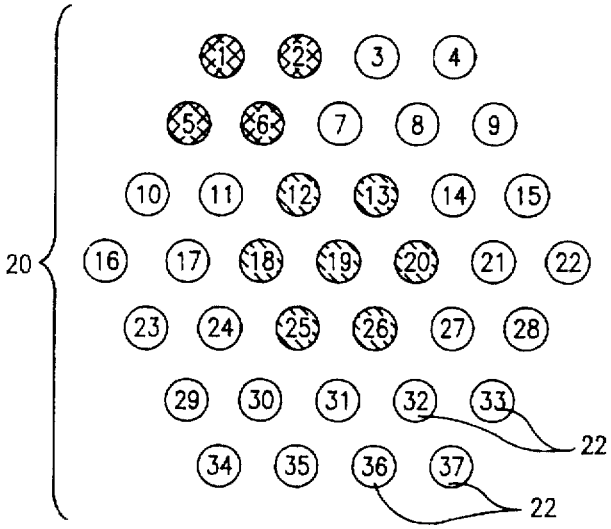
FIG. 2 illustrates an exemplary feed element configuration for use in connection with the present invention.

Turning to FIG. 2, an exemplary configuration is illustrated for the feed array 20. Feed array 20 may include any number of separate feed elements 22. Each feed element 22 may be assigned a unique identifier (as evidenced by the numbers 1–37). For purposes of description, the elements 22 have been ordered in rows and assigned ascending numbers. The elements 22 may be arranged in a hexagonal layout or any other desired layout.

Figure 3:
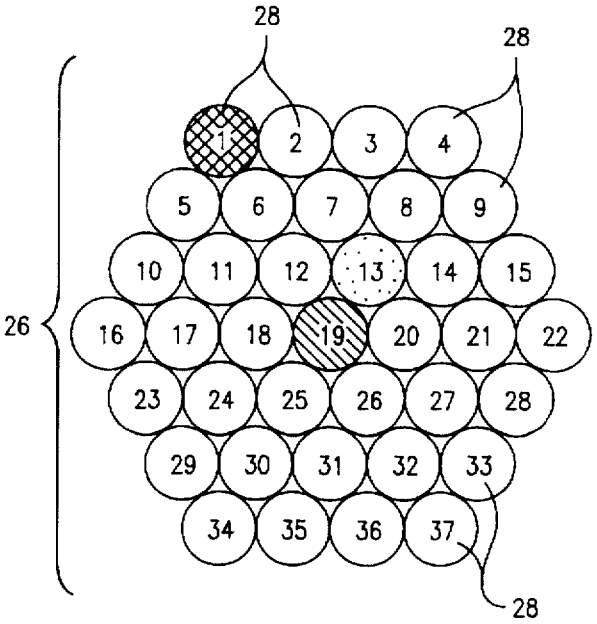
FIG. 3 illustrates an exemplary beam configuration for use in connection with the present invention.

FIG. 3 illustrates an exemplary beam configuration 26 which may be produced by the feed array 20 when operating as a transmitting unit. The beam configuration 26 includes a plurality of beams 28 (referred to hereinafter as "composite" or "communications" beams). The communications beams 28 may be similarly arranged in a hexagonal layout or any other desired layout. For purposes of illustration, each communications beam within FIG. 3 also has been assigned a unique identifier (1–37).

While the beams 28 are numbered in the same order as the feed elements 22, it is to be understood that each beam 28 is not solely or necessarily formed by a similarly numbered feed element 22 in a multiple-shared-feeds-per-beam system. Instead, a plurality of feed elements 22 cooperate to define each beam 28. According to the present invention, each beam 28 is defined by a plurality of feed elements 22 located adjacent to one another in a cluster or group. By way of example, in a transmitter application, beam #1 is generated by elements #1, #2, #5 and #6 (as noted by similar hatching), each of which transmits a component or portion thereof. The beam components transmitted by elements #1, #2, #5 and #6 combine to equal beam #1. Beam #19 is generated by elements #12, #13, #18, #19, #20, #25 and #26, each of which transmits a component of the resultant beam #19. Beam #13 is generated by elements #7, #8, #12, #13, #14, #19 and #20, each of which transmits a portion or component of the beam #13. From this example it is clear that clusters of elements 22 grouped adjacent to one another cooperate to define each beam 28. The number of elements 22 within each group used to form a beam 28 may vary. It is also clear that each element may transmit beam components of more than one beam 28 simultaneously.

Figure 4:
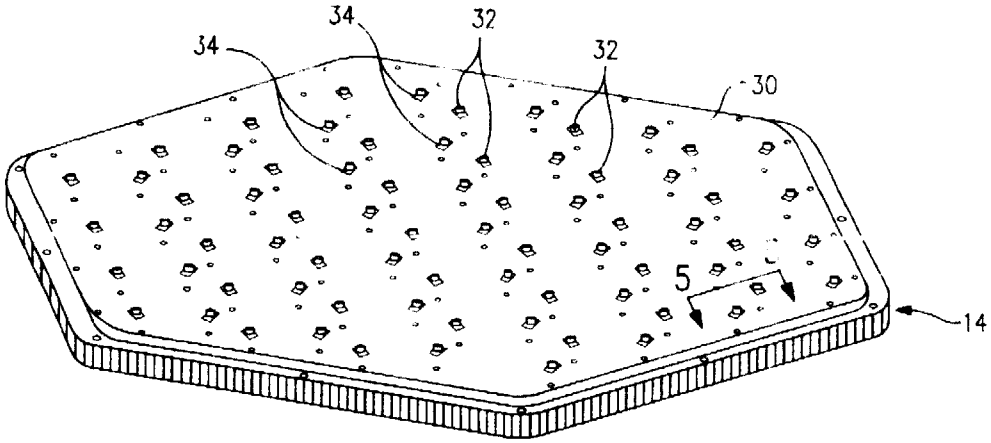
FIG. 4 illustrates a perspective view of a beam forming network according to the present invention.

Turning to FIG. 4, a perspective view of a BFN 14 is illustrated. The BFN 14 includes a plurality of feed port connectors 32 and beam port connectors 34 mounted thereto. The feed port connectors 32 are attached to the feed ports 18, while the beam port connectors 34 are attached to the beam ports 16.

Figure 5:
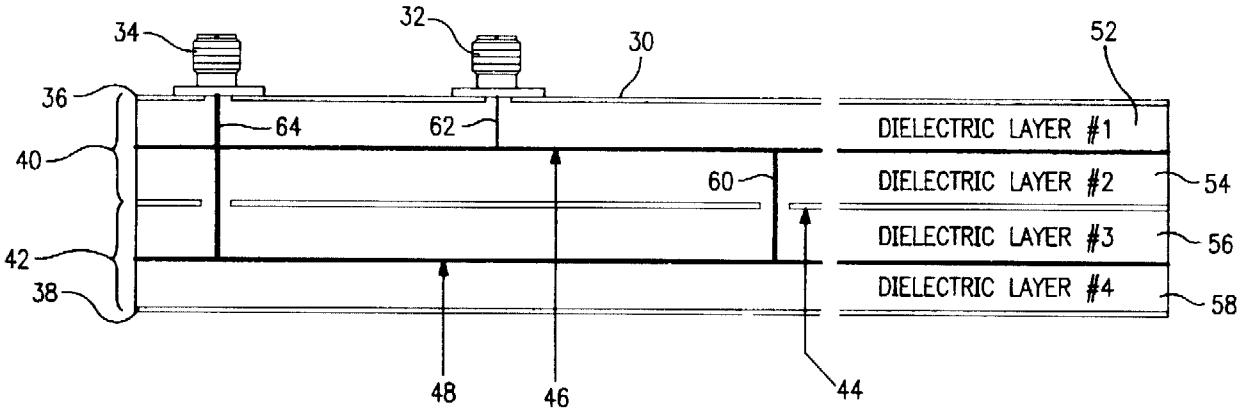
FIG. 5 illustrates a cross-sectional view taken along line 5—5 in FIG. 4 of a beam forming network according to the present invention.

With reference to FIG. 5, the feed and beam port connectors 32 and 34 are mounted to the top surface 30 of the BFN 14. Alternatively, the feed and beam port connectors 32 and 34 can be mounted to the top surface and the bottom surface of the BFN 14, respectivley. The BFN 14 includes upper and lower layers 36 and 38 which serve as grounding layers and sandwich therebetween a power combiner layer 40 and a power divider layer 42. A grounding layer 44 is disposed between the combiner layer 40 and divider layer 42. The combiner layer 40 and divider layer 42 include corresponding combiner and divider circuit traces 46 and 48, respectively, described in more detail below in connection with FIGS. 6–12. The combiner circuit trace 46 and divider circuit trace 48 may be constructed from stripline circuits of dielectric material and the like. The circuit traces 46 and 48 are separated by dielectric layers 52, 54, 56 and 58. The combiner and divider circuit traces 46 and 48 are interconnected at a plurality of points via interconnector leads 60. The feed and beam port connectors 32 and 34 are connected at desired points to the combiner and divider circuit traces 46 and 48 through interconnectors 62 and 64, respectively. The configuration of connections between the connectors 32 and 34 and traces 46 and 48 is discussed in more detail below in connection with FIGS. 6–12.

Figure 6:
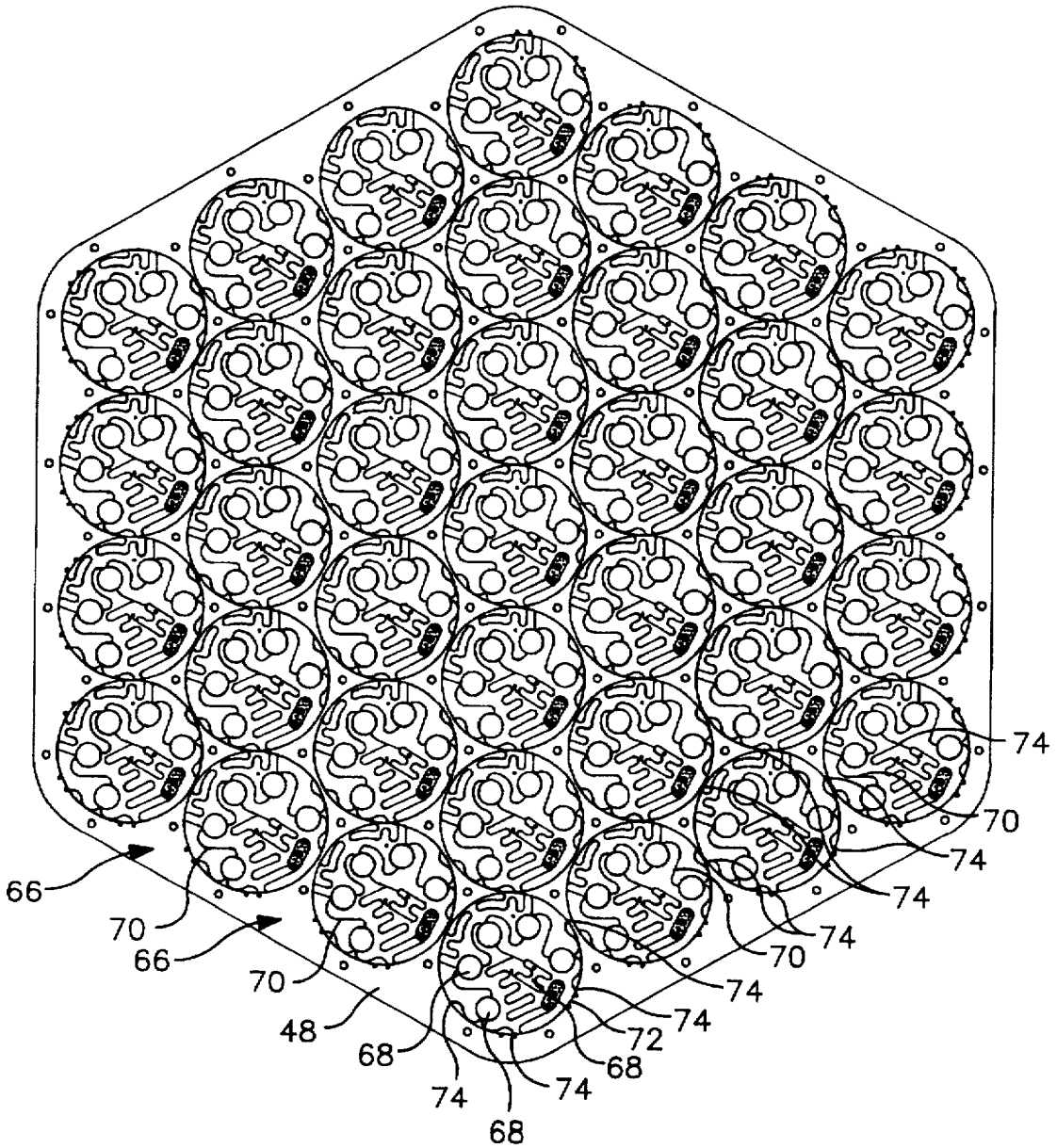
FIG. 6 illustrates a top plan view of a circuit trace for a beam divider plane according to a first embodiment of the present invention.
Figure 7:
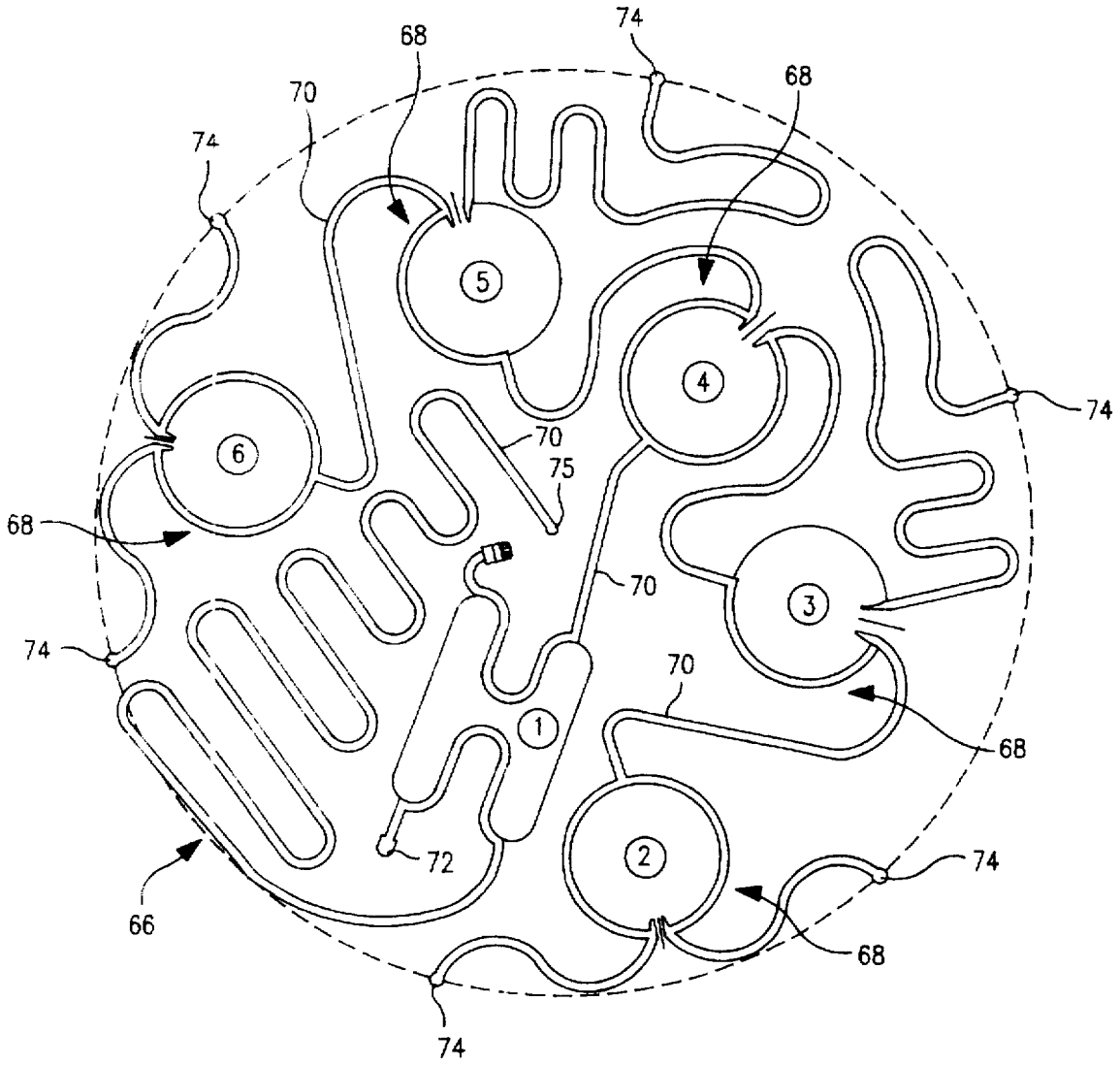
FIG. 7 illustrates a top plan view of a single beam divider according to a first embodiment of the present invention.

FIG. 6 illustrates a top plan view of the divider circuit trace 48. The circuit trace 48 includes a plurality of dividers 66, each of which is configured with a substantially circular perimeter. By way of example only, the dividers may be constructed as 7-way equal or unequal power beam dividers with each divider 66 including a plurality of two way power dividers (also referred to as sub-dividers) 68 connected to one another via leads 70. One of the sub-dividers 68 (FIG. 7) is connected to an input terminal 72. The input terminal 72 receives an incoming composite beam signal from one of the beam ports 16. The sub-dividers 68 are also attached to a plurality of output terminals 74 through leads 70. The sub-dividers 68, terminals 72 and 74 and leads 70 cooperate to receive a composite beam signal at input terminal 72 and equally or unequally divide a power level of the composite beam signal among the output terminals 74. In the present example, 7 output terminals 74 are utilized within each divider 66.

Figure 8:
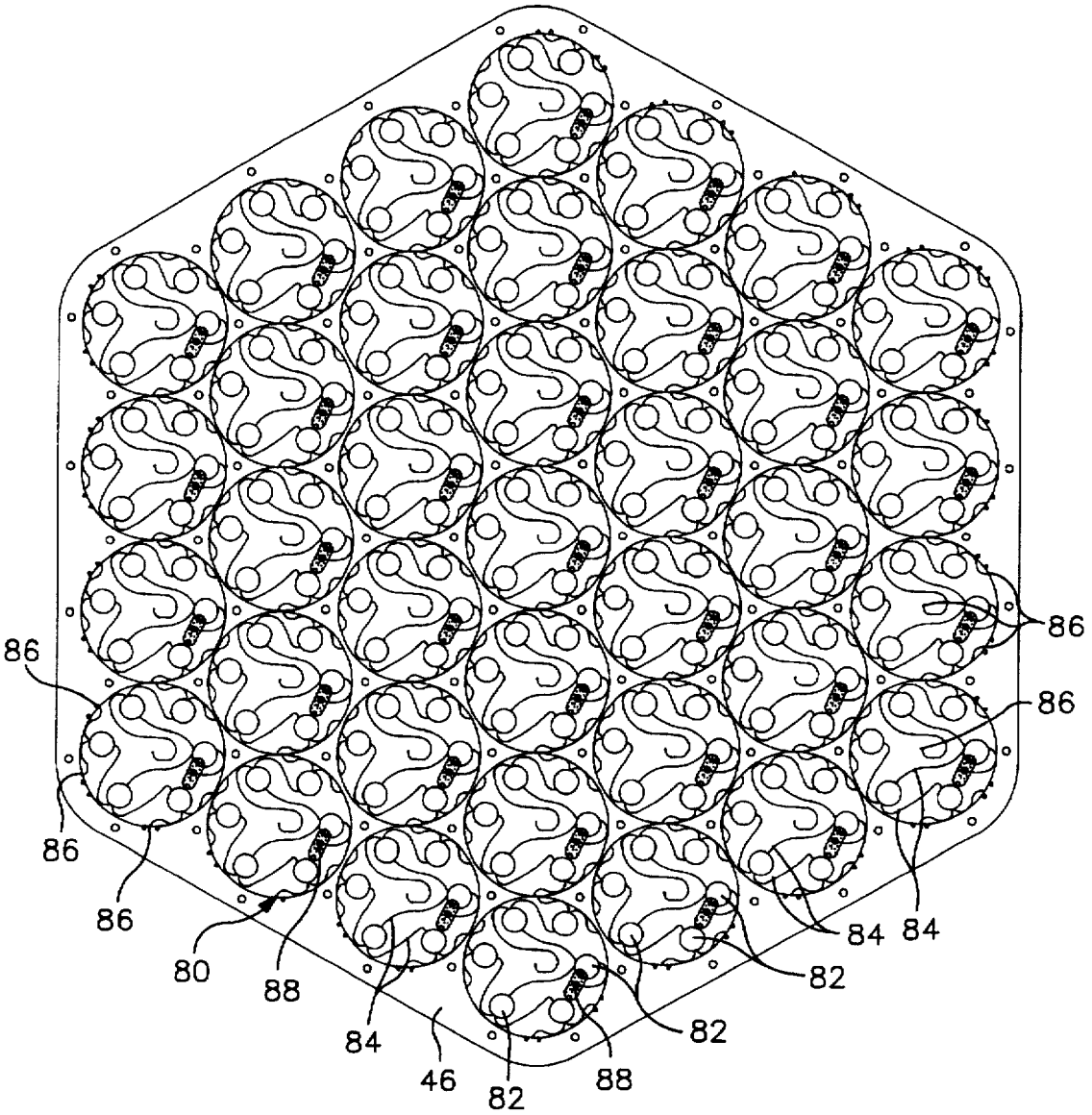
FIG. 8 illustrates a top plan view of a circuit trace for a beam combiner plane according to a first embodiment of the present invention.

Turning to FIG. 8, a top plan view is illustrated of a combiner circuit trace 46. The circuit trace 46 includes a plurality of combiners 80 having substantial circular outlines or perimeters. The combiners 80 are located immediately adjacent one another in a substantially hexagonal layout. In the preferred embodiment, the combiners 80 represent seven way equal or unequal power beam combiners.

Figure 9:
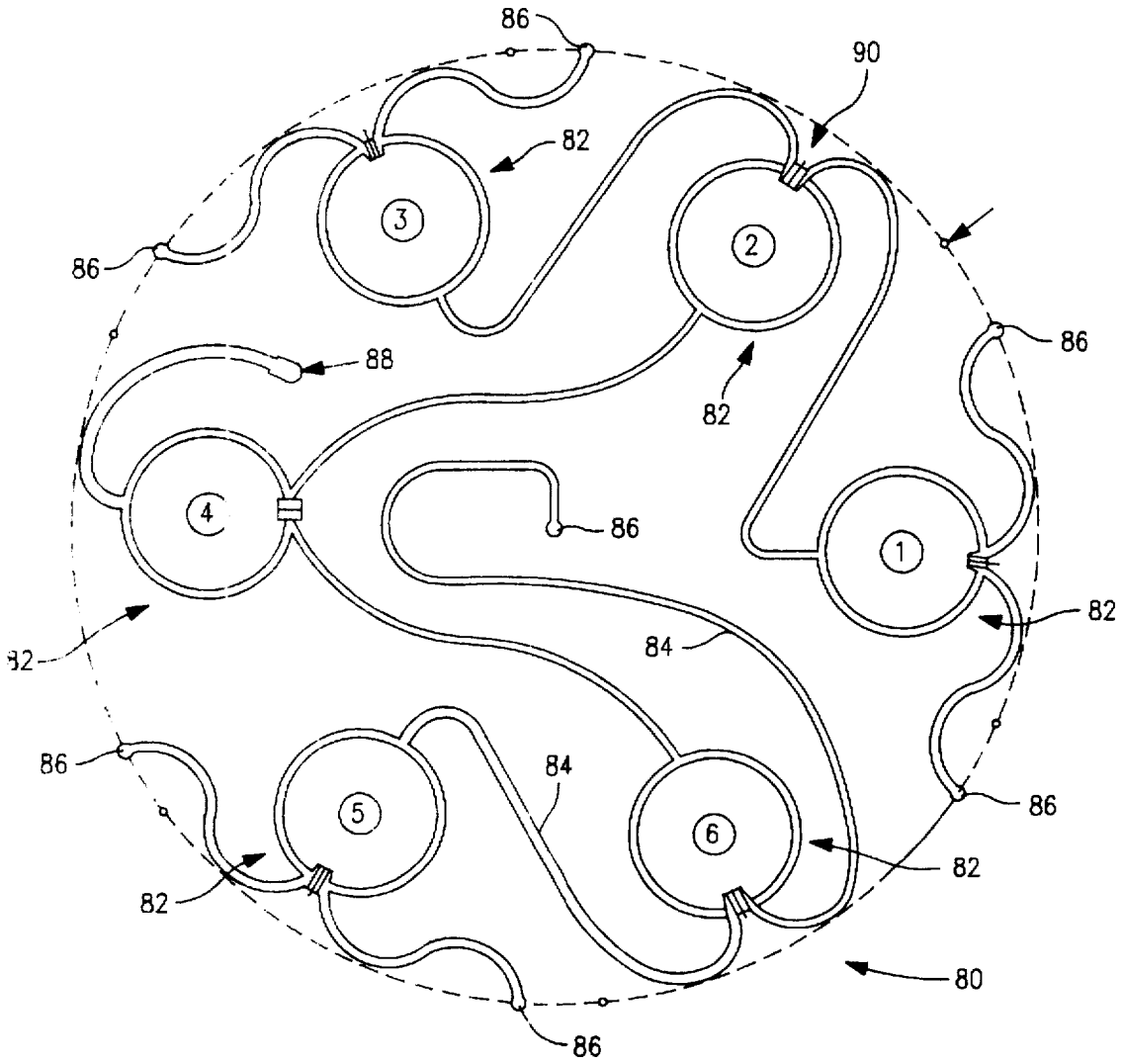
FIG. 9 illustrates a top plan view of a single beam combiner according to a first embodiment of the present invention.

As illustrated in more detail in FIG. 9, each combiner 80 includes a plurality of two way power dividers or sub-dividers 82 disposed thereabout and interconnected via leads 84. The sub-dividers 82 communicate with a plurality of input terminals 86. One of the sub-dividers 82 communicates with an output terminal 88. Resisters 90 are utilized to achieve two way power division in the combiners 80 and dividers 66.

Optionally, the sub-dividers 68 and 82 may be implemented using Wilkinson power dividers, hybrids, couplers and the like so long as the resultant combiners 80 and dividers 66 achieve the objectives of the present inventions.

Figure 10:
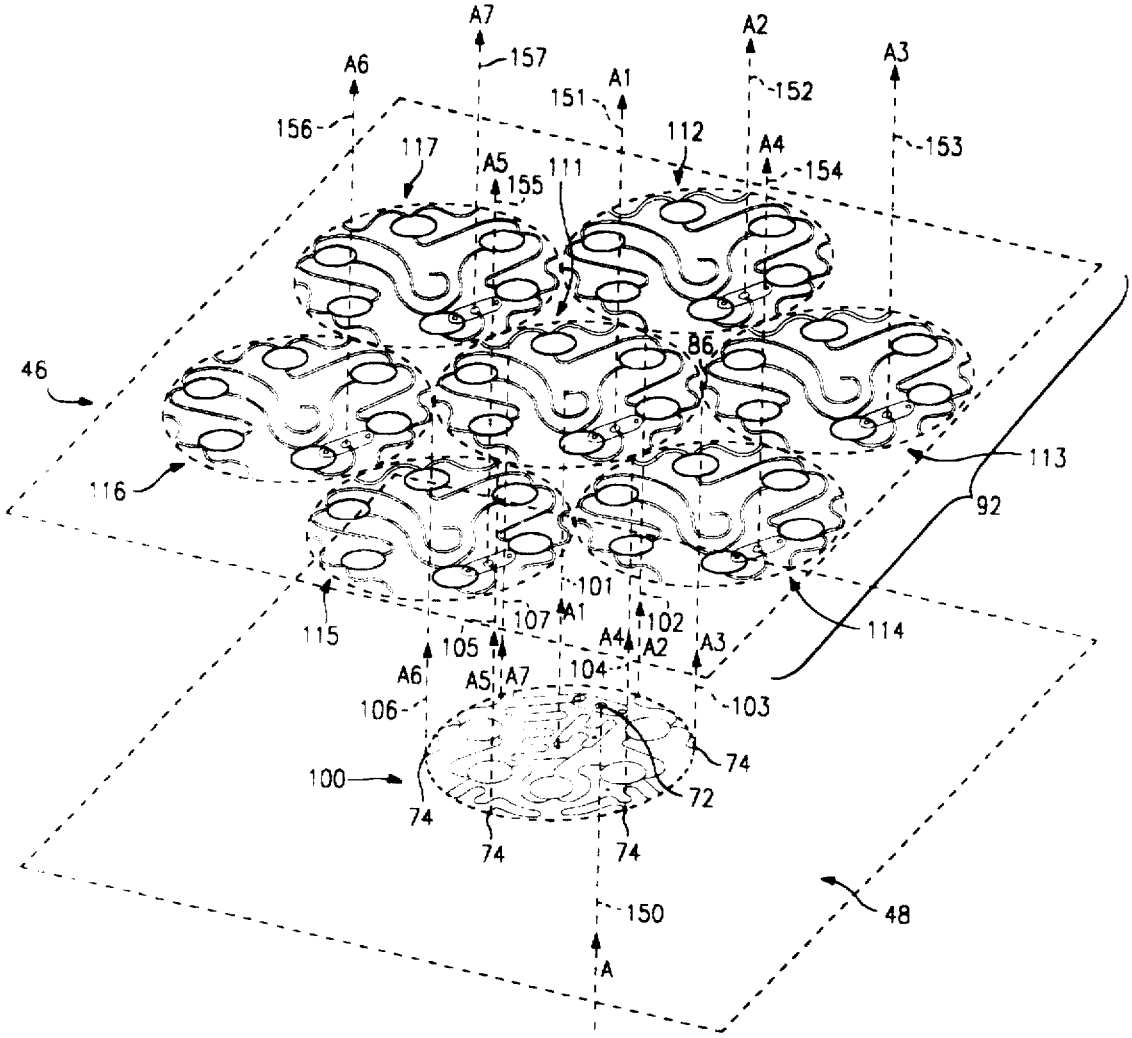
FIG. 10 illustrates a perspective exploded view of a beam divider connected to an associated cluster of beam combiners in opposed planes.

Next, reference is made to FIG. 10 in connection with the description of the interconnection between a single divider 100 and a cluster 92 of corresponding combiners 111–117. The divider 100 is connected at the input terminal 72 to a beam port 150 (generally designated by the dashed line). It is assumed that a composite beam signal A is delivered along beam port 150 to divider 100. The output terminals 74 of the divider 100 are connected via the interconnector leads 101–107 to corresponding input terminals 86 of the combiners 111–117 within cluster 92. The composite beam signal A is split into seven lower power components $A_1$–$A_7$. The beam component signals $A_1$–$A_7$ are delivered separately along leads 101–107 to corresponding combiners 111–117, respectively. The combiners 111–117 output corresponding beam component signals $A_1$–$A_7$, respectively, along feed ports 151–157 to seven corresponding feed elements 22. With reference to FIGS. 2, 3 and 10, if composite beam signal A corresponds to beam #19 (FIG. 3) then beam component signals $A_1$–$A_7$ are delivered to feed elements #12, #13, #18, #19, #20, #25 and #26.

The combiners 111–117 which receive input signals from the single divider 100 are located immediately adjacent one another. By arranging the combiners 111–117 in clusters 92, excessively long interconnection leads are avoided. The leads 101–107 are substantially of equal length and aligned substantially perpendicular to the circuit traces 46 and 48.

Figure 11:
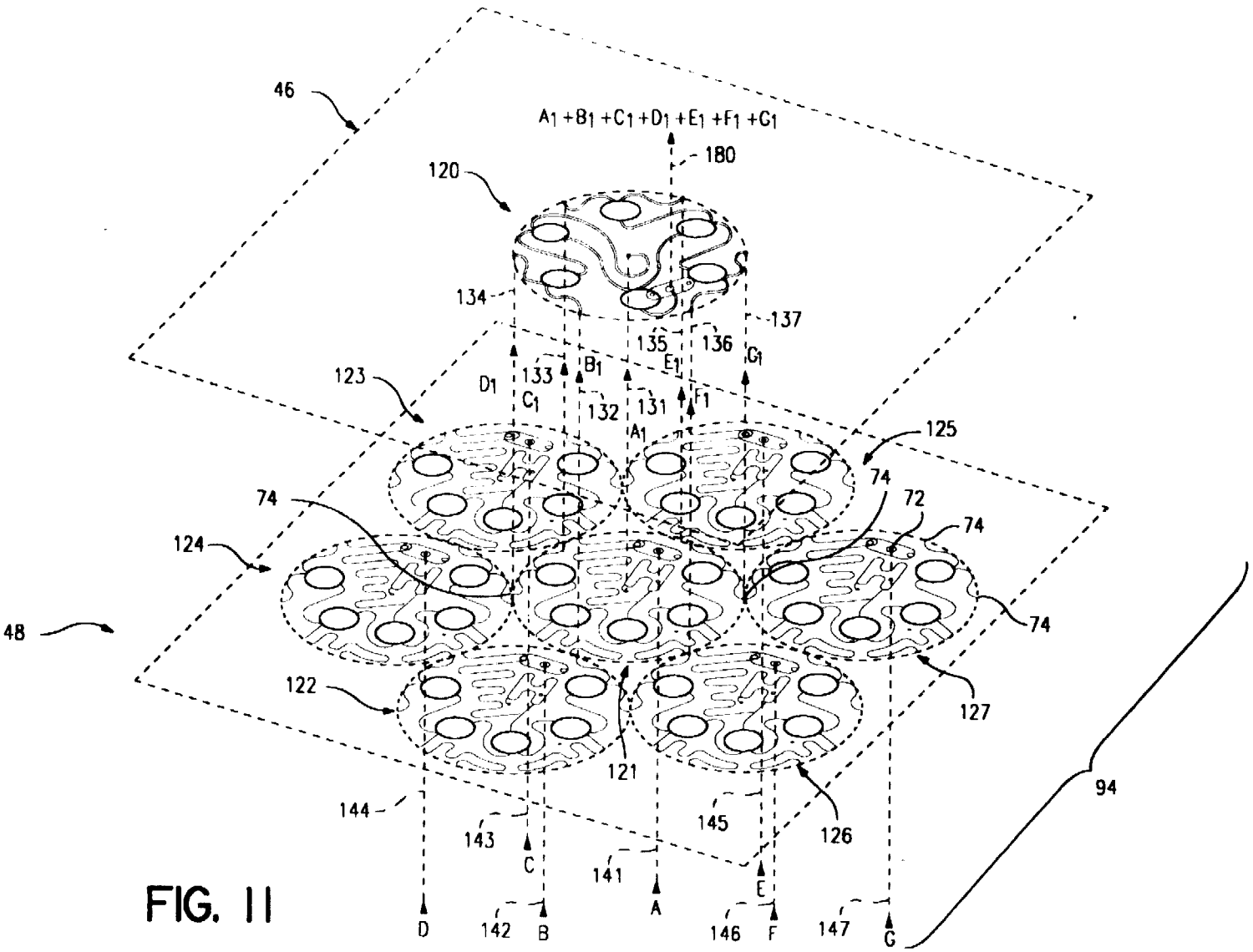
FIG. 11 illustrates a perspective exploded view of a beam combiner connected to an associated cluster of beam dividers in opposed planes.

FIG. 11 illustrates the arrangement and interconnection between a single combiner 120 and a plurality of dividers 121–127. The dividers 121–127 are similarly grouped to form a cluster 94, wherein each divider 121–127 in the cluster 94 delivers at least one output signal to the common combiner 120 via interconnection leads 131–137. During operation, beam ports 141–147 deliver composite beam signals to input terminals 72 of corresponding dividers 121–127. Each composite beam signal is divided into multiple beam component signals, each of which is delivered from an output terminal 74. The plurality of beam component signals are delivered to different combiners. For example, if each composite beam signal is to be divided into seven component signals, these seven components may be delivered to seven separate combiners.

With reference to FIG. 11, it is assumed that dividers 121–127 receive composite beam signals A–G. The dividers 121–127 separate the composite beam signals A–G into beam component signals $A_1$–$A_7$ through $G_1$–$G_7$, of which only signals $A_1$, $B_1$, $C_1$, $D_1$, $E_1$, $F_1$ and $G_1$ are illustrated. The dividers 121–127 then deliver associated components $A_1$, $B_1$, $C_1$, $D_1$, $E_1$, $F_1$, $G_1$ to the combiner 120. The beam component signals $A_1$–$G_1$ are output along feed port 160 as a feed signal equaling the combination of beam component signals $A_1+B_1+C_1+D_1+E_1+F_1+G_1$. The feed signal along feed port 160 is in turn transmitted from a corresponding feed element 22.

Figure 12:
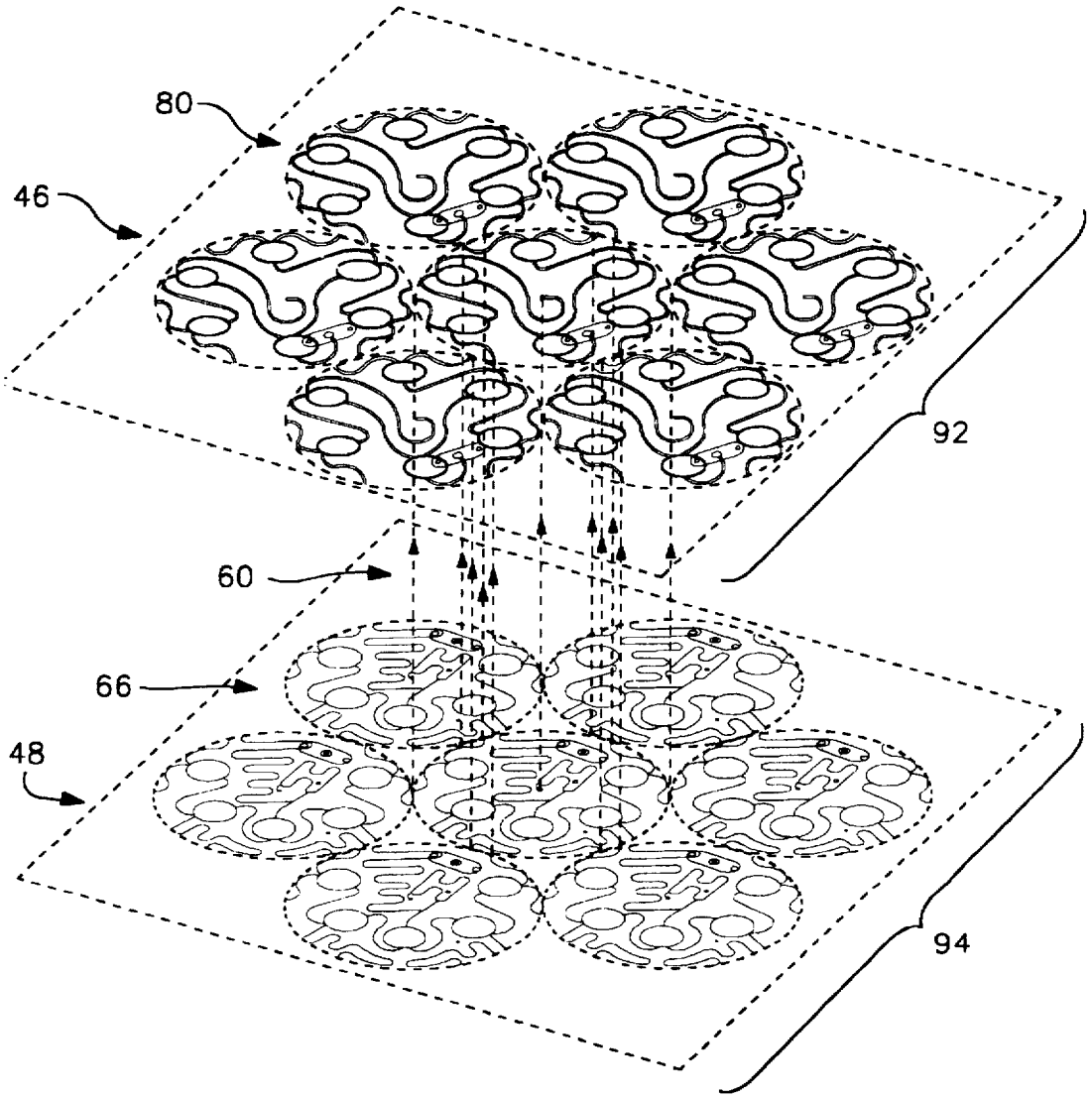
FIG. 12 illustrates a perspective exploded view of a cluster of beam dividers connected to a cluster of beam combiners.

FIG. 12 illustrates two clusters 92 and 94 of combiners 80 and dividers 66 connected through the corresponding interconnection leads 60. The foregoing configuration arranges the dividers 66 and combiners 80 evenly along two substantially parallel planes. The input and output terminals are preferably arranged directly opposite associated input and output terminals. This arrangement aligns the leads 60 substantially parallel to one another and along axes substantially perpendicular to the planes of the dividers 66 and combiners 80. This arrangement also enables all of the leads 60 to be substantially of equal length.

It is to be understood that the foregoing invention is equally useful within transmitters and receivers. While the above description is provided in connection with a transmitter, the beam forming network will operate equally well with the signals passing in the opposite directions to those illustrated in FIGS. 6–12.

The foregoing beam forming network reduces the interconnection complexity by maximizing the use of local interconnections and by insuring that each feed element in the hexagonal array layout is only shared by nearby beams in the hexagonal layout. While the preferred embodiment utilizes 37 feed elements and beams, any number of feed elements, beams, beam ports and feed ports may be utilized. Similarly, the inventive system is not limited to a hexagonal layout, but optionally may be utilized with other configurations, such as circular, square, rectangular and the like. Moreover, while the preferred divider and combiner network utilizes seven way elements, the invention is not so limited. Instead, each divider may divide a composite beam signal into any desired number of components. Similarly, the combiners may combine any number of beam components to form a single feed signal. In addition, each combiner may receive more than one beam component signal from a single divider. Also, the dividers need not necessarily evenly divide the composite beam signal, but instead may divide it unevenly between the output terminals.

While alternatives to the preferred embodiment have been described, these are to be considered exemplary only and not as limitations on the scope of the invention, which is defined only by the appended claims.

We claim:

1. A multiple beam antenna system comprising:

a feed array operating in conjunction with composite beams and feed signals, said feed signals containing beam component signals representative of components of said composite beams;

a beam forming network having beam ports for conveying composite beam signals representative of said composite beams and feed ports connected to said feed array, said feed ports conveying said feed signals, said beam forming network having dividers for dividing said composite beam signals into beam component signals and having combiners for combining beam component signals representative of components of multiple composite beams to form each feed signal; and a plurality of individual interconnections between said dividers and said combiners, each of said dividers being interconnected to proximately located combiners, each of said plurality of individual interconnections having substantially equal propagation delays.

2. A system according to claim 1, where said beam forming network further comprises first and second circuit traces aligned along substantially parallel planes, said first circuit trace containing said combiners and said second circuit trace containing said dividers.

3. A system according to claim 1, wherein said beam forming network contains a plurality of combiners arranged in a first plane and a plurality of dividers arranged in a second plane immediately adjacent said first plane, said combiners being grouped into clusters wherein each combiner in a cluster corresponds to a common composite beam signal.

4. A system according to claim 1, wherein said combiners are grouped into clusters such that all combiners associated with a single composite beam signal are located immediately adjacent one another.

5. A system according to claim 1, where said dividers are grouped into clusters such that all dividers associated with a single feed signal are located immediately adjacent one another.

6. A system according to claim 1, wherein all combiners associated with a first composite beam signal are located immediately adjacent one another in a first combiner cluster, said first combiner cluster being located proximate a first divider cluster, said first divider cluster exclusively containing all dividers associated with a first feed signal containing at least one beam component signal from said first composite beam signal.

7. A system according to claim 1, wherein said combiners are clustered based on corresponding composite beam signals, and wherein at least one divider is arranged immediately adjacent and centered with respect to a cluster of combiners corresponding to a composite beam signal.

8. A system according to claim 1, wherein said dividers are clustered based on corresponding feed signals, and wherein at least one combiner is arranged immediately adjacent and centered with respect to a cluster of dividers corresponding to a feed signal.

9. A system according to claim 1, wherein each of said dividers is substantially circular and includes a plurality of output terminals spaced about a circumference thereof, said output terminals being connected to input terminals upon an equal plurality of combiner.

10. A system according to claim 1, wherein each of said combiners is substantially circular and includes a plurality of input terminals spaced about a circumference thereof, said input terminals being connected to output terminals of an equal plurality of dividers.

11. A system according to claim 1, wherein said combiners and dividers are interconnected through leads of substantially equal length.

12. A system according to claim 1, wherein said combiners and dividers are interconnected through leads extending between parallel planes containing said combiners and dividers, said leads extending substantially perpendicular to said parallel planes.

13. A multiple beam antenna system comprising:

a feed array operating in conjunction with composite beams and feed signals, said feed signals containing beam component signals representative of components of said composite beams; and a beam forming network having beam ports for conveying composite beam signals representative of said composite beams and feed ports connected to said feed array, said feed ports conveying said feed signals, said beam forming network having dividers for dividing said composite beam signals into beam component signals and having combiners for combining beam component signals representative of components of multiple composite beams to form each feed signal, said dividers and combiners being locally interconnected wherein each divider only connects with combiners located immediately proximate to said divider; wherein each of said dividers is substantially circular and includes a plurality of output terminals spaced about a circumference thereof, said output terminals being connected to input terminals upon an equal plurality of combiners.

14. A multiple beam antenna system comprising:

a feed array operating in conjunction with composite beams and feed signals, said feed signals containing beam component signals representative of components of said composite beams; and a beam forming network having beam ports for conveying composite beam signals representative of said composite beams and feed ports connected to said feed array, said feed ports conveying said feed signals, said beam forming network having dividers for dividing said composite beam signals into beam component signals and having combiners for combining beam component signals representative of components of multiple composite beams to form each feed signal, said dividers and combiners being locally interconnected wherein each divider only connects with combiners located immediately proximate to said divider; wherein each of said combiners is substantially circular and includes a plurality of input terminals spaced about a circumference thereof, said input terminals being connected to output terminals upon an equal plurality of dividers.

* * * * *